US006772811B1

(12) United States Patent
Kim

(10) Patent No.: US 6,772,811 B1
(45) Date of Patent: Aug. 10, 2004

(54) GOLF CLUB HEAD COVER

(76) Inventor: Hoseong Kim, Mokdong Sinsigaji-apt, 110-102, Mok-dong, Yangchun-ku, Seoul (KR)

( * ) Notice: Subject to any disclaimer, the term of this patent is extended or adjusted under 35 U.S.C. 154(b) by 0 days.

(21) Appl. No.: 10/329,894

(22) Filed: Dec. 26, 2002

(51) Int. Cl.[7] ..... A63B 57/00
(52) U.S. Cl. ..... 150/160; 206/315.2; 206/315.4
(58) Field of Search ..... 150/159, 160; 206/315.2, 315.3, 315.4

(56) References Cited

U.S. PATENT DOCUMENTS 3,548,908 A * 12/1970 Koetting ..... 150/160
5,769,141 A * 6/1998 Rinehard ..... 150/160
6,085,814 A 7/2000 Choe ..... 150/160
6,095,214 A 8/2000 Gaffney ..... 150/160
6,230,886 B1 * 5/2001 Bradshaw ..... 206/315.2
6,398,025 B2 6/2002 Choe ..... 206/315.2

FOREIGN PATENT DOCUMENTS

GB 2233239 A * 1/1991 ..... A63B/55/00

* cited by examiner

*Primary Examiner*—Sue A. Weaver
(74) *Attorney, Agent, or Firm*—Young & Basile, P.C.

(57) ABSTRACT

A golf club head cover for use with standard wood golf clubs and oversized wood golf clubs is disclosed and made primarily of non-stretchable fabric and a narrow strip of elastic material. The head cover has a tubular formation having a first end stitched to an elongated sleeve shaft and a second end stitched to another piece of material to close the second end. The narrow strip of elastic material extends from the first end to the second end to accommodate the receipt of an oversized golf club head. The narrow strip of elastic material encompasses less than fifteen percent of the tubular formation so as not to detract from the decorative qualities of the non-stretchable fabric.

12 Claims, 2 Drawing Sheets

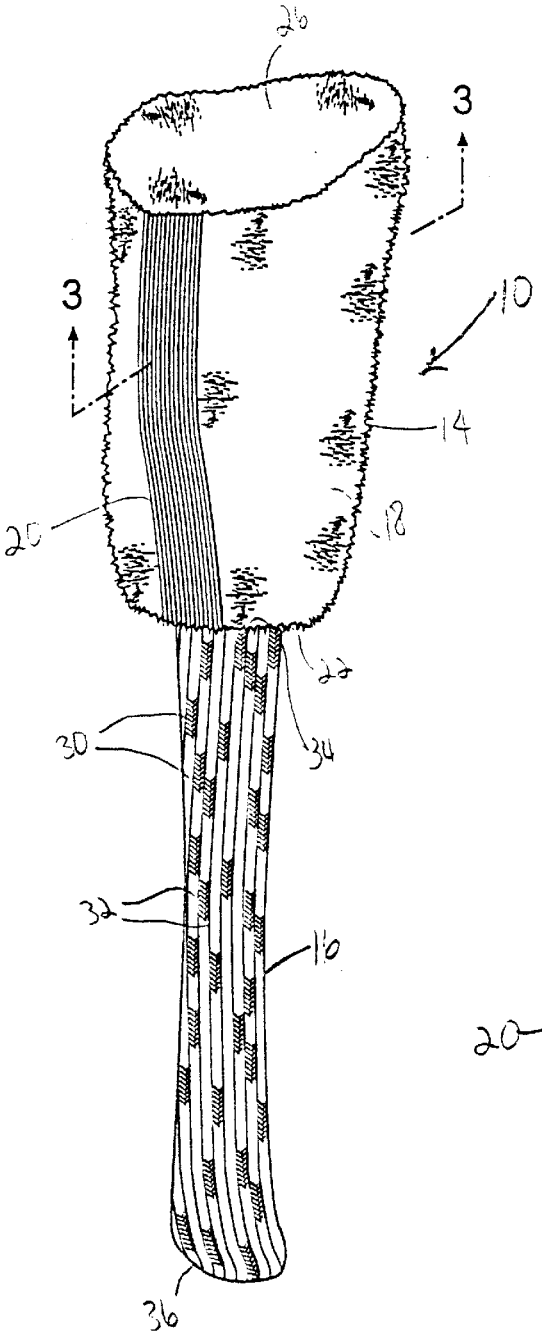
FIG - 2
FIG - 3
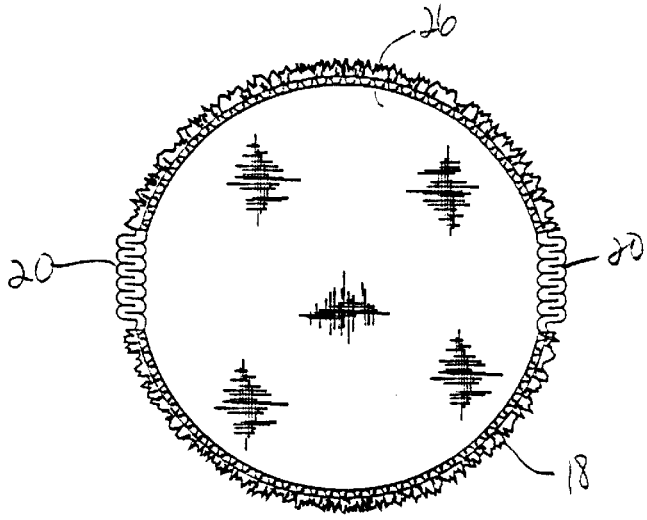

GOLF CLUB HEAD COVER

FIELD OF THE INVENTION

The present invention relates, in general, to head covers for golf clubs and, in particular, for head covers capable of receiving the oversized golf club heads.

BACKGROUND OF THE INVENTION

Golf club head covers have been used for numerous years to protect the heads of golf clubs, especially the wood clubs, from hitting other clubs within the golf bag during the transport of the golf clubs. Typically, the head cover is made of a soft, plush or padded material that extends over and around the golf club head. The golf club head cover may also extend over a portion of the shaft or may be connected to a narrow band of highly elasticized material that extends over a portion of the shaft. With the advent and the increased use of the oversized golf club head, the typical golf club head cover can no longer adequately be fitted thereon.

One option has been to provide a set of golf club head covers in which at least one head cover of the set has a larger inner capacity than the remaining head covers of the set. This larger head cover would then be used for the oversized, large drivers. However, this can provide a manufacturing and inventory problem since two sizes of golf club head covers would need to be manufactured. Also, not every golfer has an oversized golf club and would therefore not require the oversized head cover.

As a result, two sets of golf head covers would need to be packaged to accommodate both golfers who have an oversized golf club head and those who do not have an oversized golf club head.

Therefore, it is desirable to provide a golf club head cover that can be used for both standard wood golf clubs as well as the oversized driver wood golf clubs. It is also desirable to provide a golf club head cover that can automatically expand to accommodate an oversized golf club head, but does not detract from the overall look of the golf club head cover as provided by the soft, plush or padded material.

SUMMARY OF THE INVENTION

This invention addresses the aforementioned concerns by providing a head cover for golf clubs comprising a first member made of a non-stretchable material and configured to have a tubular shape for receiving a club head. This first member has a closed first end and an opposing second end. A second member defines an elongated sleeve integrally connected to the second end of the first member, wherein the first member has an elastic strip extending from the first end to the second end for allowing the golf club head cover to expand for oversize golf club heads without detracting from the non-stretchable material.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 2 is a perspective view of a second embodiment of the invention; and

FIG. 3 is a cross-sectional view of the golf club head cover of FIG. 2 taken along the lines of 3—3.

DESCRIPTION OF THE PREFERRED EMBODIMENT

Figure 1:
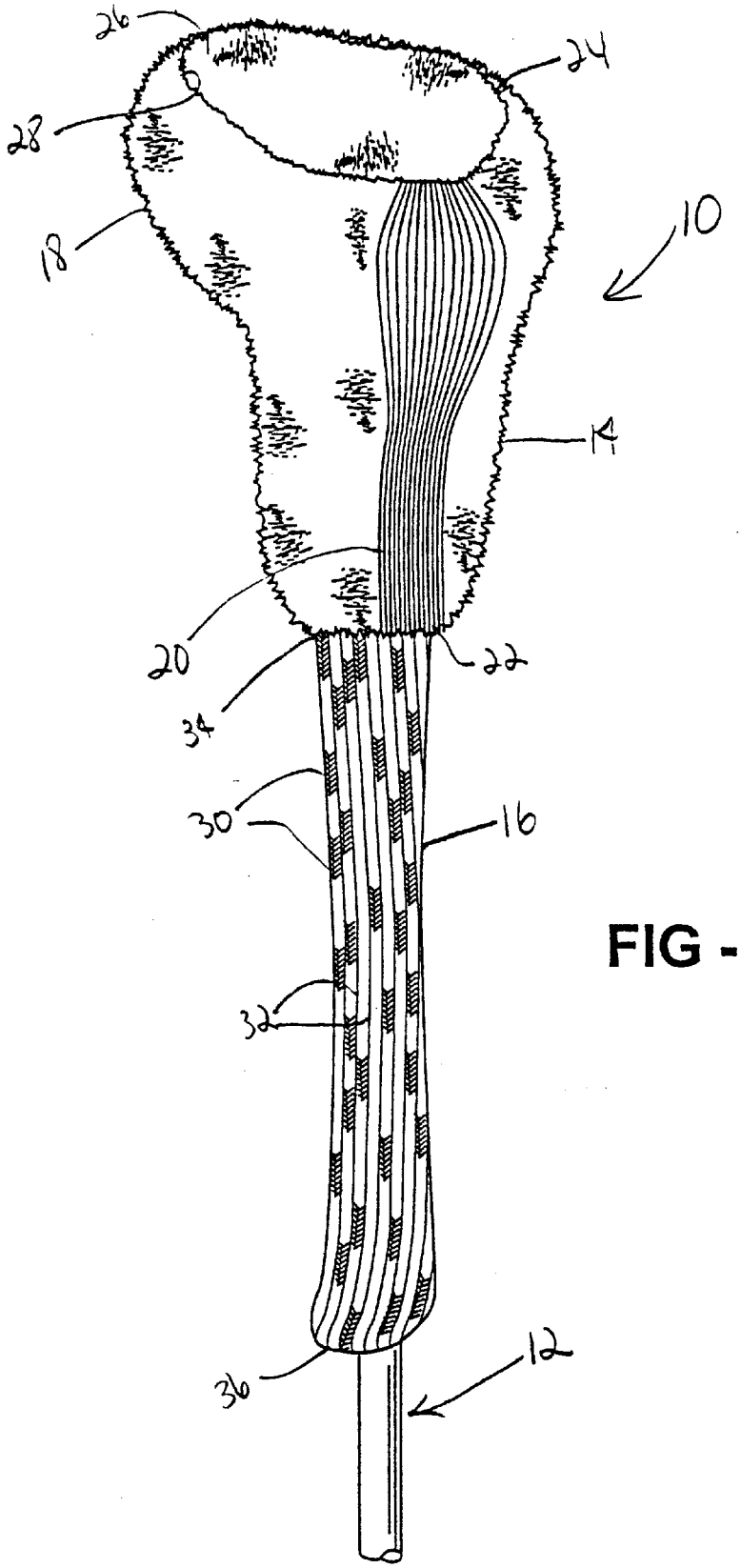
FIG. 1 is a perspective view of the golf club head cover according to the first embodiment of the invention with a golf club inserted therein.

FIG. 1 shows a first embodiment for a head cover 10 according to the present invention which allows for the disposition of oversized wood clubs 12. The head cover 10 includes a first member 14 which provides a head protection cover and a second member 16 providing a shaft sleeve. The first and second members 14, 16, respectively, are stitched together at one of each of their ends.

The first member 14 constituting the head protection cover has a tubular configuration made of a non-stretch material 18 that is padded or has a plush or cushioning texture. Preferably at the seam of the tubular configuration, a narrow strip of elastic material 20, such as elastic rubber, is inserted and attached, preferably by stitching, to the tubular configuration of the head cover. The narrow strip of elastic material 20 extends from the first end 22 of the head protection cover which is stitched to the shaft sleeve 16 to the opposite end of the tubular configuration. The opposite end, or second end 24, of the head protection cover 10 is closed by an essentially circular piece 26 of material which is preferably made from the same non-stretch material used for the main portion 18 of the tubular configuration of the head protection cover 10. The peripheral edge 28 of the circular piece 26 of material is stitched to the second end 24 of the tubular configuration which includes both the non-stretch material and the narrow strip of elastic material 20.

As stated, supra, the second member 16 of the head protection cover provides a shaft sleeve 16 for the golf club 12. The shaft sleeve 16 forms an elongated, narrow tubular member preferably made of a knit material which includes elastic thread 30 and further includes a plurality of elongated parallel elastic seams 32 similar to seams in athletic socks to provide ample stretching ability for the larger golf club heads. One end 34 of the second member 16 is stitched to the first member 14. The opposing end 36 of the shaft sleeve 16 remains open for receiving the golf club head.

The second embodiment, as shown in FIGS. 2 and 3, also provides a head protection cover having a first member as the head protection cover 14 and a second member 16 as the shaft sleeve made of a non-stretch material which is padded or otherwise has cushioning attributes. The head protection cover 14 has a substantially tubular configuration Disposed within the tubular configuration are a pair of narrow strips of elastic material 20 extending the axial length of the head cover. The pair of narrow strips of elastic material 20 are positioned at 180° from each other and having the non-stretch material 18 disposed therebetween, as shown in FIG. 3. The first end 22 of the tubular configuration of the head protection cover is connected preferably by stitching to the second member or shaft sleeve 16 of the golf club cover 10.

As in the first embodiment, the shaft sleeve 16 is an elongated narrow member made of a knit material including elastic thread 30 and includes a plurality of elongated parallel elastic seams 32 to provide ample stretching ability to accommodate the oversized golf club head.

Both embodiments of the present invention provides a golf club head protection cover 14 that can be used for both oversized golf club heads as well as regular wood heads. If a regular sized wood golf club head is disposed within the golf club head cover 14 of the present invention, the narrow strip or strips of elastic material 20 in the first member 14 will have little or no expansion. However, since there is little elastic material 20 relative to the remaining non-stretch material 18 comprising the head protection cover 14, the head cover 14 fits snugly over the regular sized wood head. If an oversized wood golf club head is disposed within the head protection cover 10 of the present invention, the elastic strip or strips 20 of the head protection cover will expand as shown in FIG. 1 to accommodate the form of the oversized golf club head. As a result, the golf club head protection cover 14 of the present invention provides a golf club head cover that accommodates the many sizes of wood golf club heads on the market.

In addition, the golf club head cover 10 of the present invention accommodates various golf club head sizes without detracting from the overall decorative nature of the non-stretch material 18. Although the function of head covers for golf clubs is primarily to prevent the heads of the clubs 12 from hitting against each other and thereby damaging the heads, the head covers are also provided for a decorative function. The non-stretch material 18 is usually made of a plush, soft material made in various decorative colors. For manufacturing and economic reasons, the narrow strips of elastic material 20, such as elastic rubber, are generally black in color. In order to not detract from the decorative nature of the non-stretch material, the narrow strip or strips of elastic material 20 cover should cover less than twenty percent, and, preferably, less than fifteen percent of the circumferential area of the tubular configuration of the head protection cover 14. The orientation of the strips of the elastic material 20 relative to the non-stretch material 18 provides adequate stretching ability of the golf club protection cover if the strips of the elastic material 20 encompass at least five percent of the circumferential area of the tubular configuration of the head protection cover 14, although ten percent is preferred.

This minimum amount of black stretch, elastic material 20 is beneficial and advantageous for use on novelty golf head protection covers, as well. It is increasingly popular to form the golf club head protection cover with the features of a college or professional sporting team mascot, a cartoon character, or a celebrity, etc. The narrow strip or strips of elastic material can be placed either 180° away from the features of the novelty character or at 90° from the features of the novelty character without detracting from the features of the novelty character of the golf club head cover. Golf club head covers 10 incorporating wide bands of elastic material generally cannot easily include the features for novelty golf head protection covers.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A head cover for golf clubs, comprising:

a first member made of a non-stretchable material having decorative qualities and configured to have a shape corresponding to a portion of a club head, said first member having a closed first end and an opposing second end;

a second member defining an elongated sleeve integrally connected to the second end of the first member, wherein said first member has an elastic strip extending from the first end to the second end for allowing the golf club head cover to expand for oversize golf club heads, wherein said elastic strip encompasses less than 20% of the material of the first member for preventing detraction from the decorative qualities of the non-stretchable material; and for providing the cover with a snug fit over both a regular sized wood head or an oversized wood head.

2. The head cover of claim 1, wherein the elastic strip encompasses less than fifteen percent of the material of the first member to prevent detraction from the decorative qualities of the non-stretchable material; and for providing the cover with a snug fit over both a regular sized wood head or an oversized wood head.

3. The head cover of claim 1, wherein the first member has a generally tubular shape and an end piece having a substantially circular periphery, said end piece made of a non-stretchable material and sewn along the substantially circular periphery of the first end of the first member for closing said first end of the first member and wherein the elastic strip extends the axial length of the tubular shaped first member.

4. The head cover of claim 3, wherein the elastic strip encompasses at least five percent of the circumferential area of the tubular shape of the first member to provide adequate stretching ability of the head cover without detracting from the non-stretchable material; and for providing the cover with a snug fit over both a regular sized wood head or an oversized wood head.

5. The head cover of claim 3, wherein the elastic strips encompass 5 to 10 percent of the circumferential area of the tubular shape of the first member to provide adequate stretching ability of the head cover without detracting from the non-stretchable material; and for providing the cover with a snug fit over both a regular sized wood head or an oversized wood head.

6. The head cover of claim 1 wherein the first member has a pair of elastic strips, each elastic strip extending from the first end to the second end, said pair of elastic strips separated by non-stretchable material.

7. The head cover of claim 6, wherein the elastic strips encompass less than twenty percent of the material of the first member to prevent detraction from the decorative qualities of the non-stretchable material; and for providing the cover with a snug fit over both a regular sized wood head or an oversized wood head.

8. The head cover of claim 6, wherein the elastic strips encompass less than fifteen percent of the material of the first member to prevent detraction from the decorative qualities of the non-stretchable material; and for providing the cover with a snug fit over both a regular sized wood head or an oversized wood head.

9. The head cover of claim 1, wherein the elastic strip encompasses between five to fifteen percent of the material of the first member for preventing detraction from the decorative qualities of the non-stretchable material; and for providing the cover with a snug fit over both a regular sized wood head or an oversized wood head.

10. The head cover of claim 1, wherein the first member has a tubular shape and the elastic strip encompasses 5 to 10 percent of the circumferential area of the tubular shape to provide adequate stretching ability of the head cover without detracting from the non-stretchable material; and for providing the cover with a snug fit over both a regular sized wood head or an oversized wood head.

11. The head cover of claim 1, wherein the second member is made of a knit material including elastic thread and including a plurality of elongated parallel elastic seams to provide ample stretching ability to accommodate an oversized golf club head; and for providing the cover with a snug fit over both a regular sized wood head or an oversized wood head.

12. The head cover of claim 1, wherein the non-stretchable material has decorative features thereon and the strip of elastic material is spaced at least one of 90° and 180° from the features.

* * * * *